US009528534B2

(12) United States Patent
Finke et al.

(10) Patent No.: US 9,528,534 B2
(45) Date of Patent: Dec. 27, 2016

(54) HYDRAULIC OR PNEUMATIC DRIVE FOR ACTUATING A FITTING COMPRISING A CONTROL VALVE OR SELECTOR VALVE

(75) Inventors: Hans-Juergen Finke, Meinerzhagen (DE); Meik Brinkmann, Marienheide (DE); Dirk Bracht, Burgdorf (DE)

(73) Assignees: Robert Bosch GmbH, Stuttgart (DE); E. ON Anlagenservice GmbH, Gelsenkirchen (DE)

( * ) Notice: Subject to any disclaimer, the term of this patent is extended or adjusted under 35 U.S.C. 154(b) by 693 days.

(21) Appl. No.: 13/884,234

(22) PCT Filed: Oct. 20, 2011

(86) PCT No.: PCT/EP2011/005278

§ 371 (c)(1),
(2), (4) Date: Oct. 3, 2013

(87) PCT Pub. No.: WO2012/062404

PCT Pub. Date: May 18, 2012

(65) Prior Publication Data

US 2014/0026747 A1 Jan. 30, 2014

(30) Foreign Application Priority Data

Nov. 8, 2010 (DE) ..... 10 2010 060 432
Jun. 1, 2011 (DE) ..... 10 2011 103 222

(51) Int. Cl.
*F15B 13/04* (2006.01)
*F15B 15/20* (2006.01)
*F15B 20/00* (2006.01)

(52) U.S. Cl.
CPC ..... *F15B 15/20* (2013.01); *F15B 20/008* (2013.01); *F15B 13/0405* (2013.01);
(Continued)

(58) Field of Classification Search
CPC ..... F15B 13/0405
See application file for complete search history.

(56) References Cited

U.S. PATENT DOCUMENTS 3,954,046 A * 5/1976 Stillhard ..... 91/361
5,133,189 A 7/1992 Hurley
(Continued)

FOREIGN PATENT DOCUMENTS

DE 2 025 836 12/1971
DE 198 57 890 A1 6/2000
(Continued)

OTHER PUBLICATIONS

International Search Report corresponding to PCT Application No. PCT/EP2011/005278, mailed Mar. 13, 2012 (German and English language document) (6 pages).
(Continued)

*Primary Examiner* — F. Daniel Lopez
(74) *Attorney, Agent, or Firm* — Maginot, Moore & Beck LLP

(57) ABSTRACT

A safety circuit for valves actuated hydraulically via a positioning cylinder. The positioning cylinder in one embodiment is configured to be hydraulically or pneumatically depressurized in an emergency. The positioning cylinder has two cylinder chambers configured to be fluidically connected via a working line. A first and a second series-connected shut-off valve are provided in the working line. The positioning cylinder in another embodiment is configured to be hydraulically or pneumatically actuated in an emergency. The positioning cylinder has at least one first cylinder chamber configured, in an emergency, to be supplied with pressurized fluid via a first pressure medium flow path. A first and a second series-connected shut-off valve are provided in the first pressure medium flow path.

17 Claims, 7 Drawing Sheets

(52) U.S. Cl.
CPC ... *F15B 2211/315* (2013.01); *F15B 2211/329* (2013.01); *F15B 2211/7054* (2013.01); *F15B 2211/8636* (2013.01); *F15B 2211/8757* (2013.01)

(56) References Cited

U.S. PATENT DOCUMENTS

| | | | | |
|---|---|---|---|---|
| 5,906,352 | A * | 5/1999 | Post | 251/44 |
| 6,354,185 | B1 * | 3/2002 | Sturman | 91/454 |
| 7,874,241 | B2 * | 1/2011 | Natili et al. | 91/448 |
| 2011/0030818 | A1 * | 2/2011 | Huynh | 137/511 |

FOREIGN PATENT DOCUMENTS

| | | | |
|---|---|---|---|
| DE | 20 2004 015 468 | U1 | 2/2005 |
| DE | 10 2004 042 891 | B3 | 10/2005 |
| DE | 10 2007 028 780 | A1 | 2/2008 |
| JP | 60-11790 | A | 1/1985 |
| JP | 61-141881 | U | 9/1986 |
| JP | 2005-207507 | A | 8/2005 |

OTHER PUBLICATIONS

Bosch Rexroth AG, RD 22058/07.09, 2/2-, 3/2- und 4/2-Wege-Sitzventil mit Magnetbetätigung, Lohr am Main, Germany, published at least as early as Nov. 7, 2010 (German language document) (16 pages).

Bosch Rexroth AG, RE 22058/07.09, 2/2, 3/2, and 4/2 directional seat valve with solenoid actuation, Lohr am Main, Germany, published at least as early as Nov. 7, 2010 (English language equivalent to RD 22058/07.09) (16 pages).

Bieri Hydraulik AG, "Directional seat valves ATEX", data sheet, published at least as early as Oct. 19, 2011 (16 pages).

Bosch Rexroth AG, "Directional seat valves, direct operated, with solenoid actuation", data sheet, RE 22058-XE, Apr. 2016 (16 pages).

Frankenfield, Tom, "Using Industrial Hydraulic: A state of the art textbook from Rexroth Worldwide Hydraulics", Second Edition, 1984 (7 pages, excerpted).

Hawe Hydraulik, "Directional seated valves with various actuations", data sheet, 2011 (4 pages).

Rabie, M. Galal., "Fluid power engineering", ISBN 978-0-07-162246-2, 2009 (3 pages, excerpted).

* cited by examiner

HYDRAULIC OR PNEUMATIC DRIVE FOR ACTUATING A FITTING COMPRISING A CONTROL VALVE OR SELECTOR VALVE

This application is a 35 U.S.C. §371 National Stage Application of PCT/EP2011/005278, filed on Oct. 20, 2011, which claims the benefit of priority to Serial No. DE 10 2010 060 432.1, filed on Nov. 8, 2010 in Germany, and to Serial No. DE 10 2011 103 222.7, filed on Jun. 1, 2011 in Germany, the disclosures of which are incorporated herein by reference in their entirety.

BACKGROUND

The disclosure relates to a hydraulic or pneumatic (fluidic) drive provided for the actuation of fittings which have a switching or regulating valve, which drive comprises a control cylinder and a safety circuit which, in a line to which a cylinder chamber of the control cylinder is connected, has two shut-off valves connected in series with one another. The fitting may be used for example in a power plant, in the chemical or petrochemical industry, in the field of oil and gas delivery etc. Fittings are for example servo-operated safety valves, fast-closure valves, fast-opening valves, regulating fittings, fast-closure flaps, pilot valves, internal-medium-controlled isolating valves in power plants, valves for mixing identical or different substances, etc.

DE-B 2 025 836 discloses a hydraulic safety circuit for a double-acting hydraulic cylinder with two pressure chambers, in which, in the case of a fast shut-off, the two pressure chambers are connected to one another via a plurality of pilot-controlled seat valves connected in parallel with one another. The supply for the pilot control is provided either via a check valve from the pressurized chamber of the hydraulic cylinder or via a check valve from an external pressure source. Said safety circuit can tolerate failure of one of the parallel-connected seat valves during the fast shut-off.

It is known from U.S. Pat. No. 5,133,189 for in each case two safety valves connected in series with one another to be arranged in two fluid paths which, for safety reasons, run parallel to one another. The two parallel fluid paths are provided for a redundancy in the event of a fast shut-off of a steam valve. The series connection of two safety valves makes it possible for these to be tested individually for functionality during operation.

DE 10 2004 042 891 B3 discloses a safety circuit in which four logic valves are arranged in accordance with the basic principle of the above-cited U.S. Pat. No. 5,133,189. A pressure chamber of a working cylinder can, in an emergency, be relieved of pressure via two relief lines running parallel to one another. In each relief line are provided two logic valves arranged in series with one another, of which one is an active logic valve and the other is a passive logic valve.

A disadvantage of such safety circuits is that each passive logic valve can be tested only together with the active logic valve of the parallel line. For this purpose, a connecting line with a throttle is provided between the two parallel lines.

By contrast to this, it is the object of the disclosure to provide a hydraulic or pneumatic (fluidic) drive for the actuation of fittings with a switching or regulating valve, which drive has the features of the disclosure and in which drive the safety-relevant function of the shut-off valves can be tested even individually at any time without it being necessary for the safety circuit or the regulating or switching valve or the system to be put out of operation for this purpose.

Said object is achieved by means of a hydraulic or pneumatic drive, or generally by a fluidic drive, having the features of the disclosure.

SUMMARY

The fluidic drive according to the disclosure may in particular serve for the actuation of a regulating or switching valve of a fitting for example in a power plant. The drive has a control cylinder which has at least one cylinder chamber which is connected to a hydraulic or pneumatic line. In the line there is provided a safety circuit which has two shut-off valves connected in series with one another. Here, the two shut-off valves are a first 2/2 directional cartridge valve (logic valve) and a second 2/2 directional cartridge valve (logic valve) with in each case one main control piston by means of which the fluidic connection between two respective working ports of a cartridge valve can be controlled. The two 2/2 directional cartridge valves comprise in each case one pilot-control valve. The second 2/2 directional cartridge valve is in fluidic terms arranged closer to the cylinder chamber than the first 2/2 directional cartridge valve. At least said first 2/2 directional cartridge valve is an active logic valve which has a surface which is active in an opening direction and which can be subjected to a pressure by means of the associated pilot-control valve independently of whether a pressure is prevailing at one of the working ports.

In the case of such a fluidic drive, it is ensured that the two 2/2 directional cartridge valves arranged in series with one another can be tested in succession and independently of one another. One of the two cartridge valves may be designed as a passive logic valve without an active surface, because at one of its working ports there prevails a pressure from the control cylinder or from an external pressure source, which pressure opens the cartridge valve after a release of pressure from a spring chamber of the cartridge valve by the associated pilot-control valve. The other cartridge valve, which is arranged with its working ports in series with the first cartridge valve, is an active logic valve. The pilot-control valves of the two 2/2 directional cartridge valves are situated such that their ports connected to a pressure medium source and to a pressure medium sink are in parallel with one another, that is to say can independently of one another drive the respective main stage.

The active logic valve with the surface which is active in an opening direction is preferably that 2/2 directional cartridge valve at whose working ports no pressure prevails during normal operation. Said cartridge valve may thus, for a test, be switched—in particular opened—by means of the active surface. It is preferable for both 2/2 directional cartridge valves to be active logic valves. This has the advantage that the cartridge valves exhibit particularly fast opening.

A further advantage may be seen in the fact that the valve block which has the logic valves may also, with regard to its working ports to be connected to the control cylinder, be arranged so as to be reversed with respect to the control cylinder. If, through selector valve arrangements in the form of for example two check valves or a so-called shuttle valve, it is ensured that the pilot-control valves are supplied with pressure medium in each case from the pressurized cylinder chamber and are connected with their tank port in each case to the cylinder chamber at the lower pressure, additional safety with regard to assembly is provided.

In a particularly preferred refinement of the hydraulic drive according to the disclosure, the control cylinder is a synchronous cylinder with a second cylinder chamber. Here, the two cylinder chambers can be connected to one another via the line and via the two 2/2 directional cartridge valves. It is then possible for the pressure medium to be forced out of the pressurized cylinder chamber into the other cylinder chamber such that the fitting can, under the influence of the pressure conditions thereon, pass into a safe position.

In another particularly preferred refinement, the control cylinder likewise has a second cylinder chamber, and is thus also of double-acting design. Here, the control cylinder may also be a synchronous cylinder. A synchronous cylinder is a cylinder in which effective piston surfaces of equal size face toward the two cylinder chambers. To the second cylinder chamber there is connected a second hydraulic line in which a second safety circuit is provided. The latter is designed accordingly to the first safety circuit and accordingly has a third 2/2 directional cartridge valve and, connected in series therewith, a fourth 2/2 directional cartridge valve. Said 2/2 directional cartridge valves comprise in each case one main control piston by means of which the fluidic connection between two respective working ports can be controlled, and a pilot-control valve. At least one, preferably both 2/2 directional cartridge valves of the second safety circuit are active logic valves which have a surface which is active in an opening direction and which can be subjected to a pressure by means of the associated pilot-control valve independently of the working ports. Here, testing of the cartridge valves in one line is possible independently of the cartridge valves in the other line and also independently of whether a pressure is prevailing at a working port of the third and/or fourth 2/2 directional cartridge valve.

The active logic valve with the surface which is active in an opening direction is preferably that 2/2 directional cartridge valve at whose working ports no pressure prevails during normal operation. Said cartridge valve may thus, for a test, be switched—in particular opened—by means of the active surface.

Here, in each case one branching line with a further 2/2 directional cartridge valve may be connected to the first and to the second line between the two cartridge valves. Said cartridge valves also have in each case one main control piston by means of which the fluidic connection between two respective working ports can be controlled, and they have in each case one pilot-control valve. By means of such a hydraulic drive, it is possible in an emergency for the control cylinder to be adjusted in a first or in a second direction as required.

If the main control piston is subjected to position monitoring, the functioning of the 2/2 directional cartridge valves can be tested in a simple manner. It is preferable for the closed position and the open position of a 2/2 directional cartridge valve to be monitored. If, for the position monitoring, use is made of a position sensor for example in the form of an analog sensor by means of which any position of a main control piston can be detected, then it is possible for example by means of limit stop washers for differently set opening strokes of a main control piston to be detected without the need for a limit switch to also be readjusted. It is merely necessary for a different signal of the position sensor to be regarded, by electronic means, as being decisive.

The pilot-control valves preferably also have valve bodies which are subjected to position monitoring.

In both cases, the position monitoring may be performed by means of limit switches.

To minimize leakage of control oil, it is preferable for the main control pistons to have seals. In the case of the active logic valves, said seals may be arranged in particular between the spring chamber and the active surface.

The pilot-control valves are preferably 4/2 directional cartridge valves. By means of these, the spring chamber of the associated cartridge valve can be charged with a control pressure acting in a closing direction, and here, the active surface can be relieved of pressure. In an emergency, it is (conversely) possible by means of the 4/2 directional cartridge valve for the spring chamber to be relieved of pressure and for the active surface to be subjected to a control pressure acting in an opening direction. It is preferable here for the former fluidic connections to be made in an energized switching position and for the latter fluidic connections to be made in a deenergized basic position of the 4/2 directional cartridge valve.

In a preferred refinement of the hydraulic drive according to the disclosure, all of the 2/2 directional cartridge valves are active logic valves which have a surface which is active in an opening direction and which can be subjected to a pressure by means of the associated pilot-control valve independently of the working ports. It is thus possible for each cartridge valve to be tested without a pressure prevailing at one of its working ports. The flexibility of the safety circuit is thus increased, and the repercussions of an erroneous assignment of the cartridge valves during assembly is reduced. Owing to the pressurization of the additional acting in an opening direction, the active logic valves exhibit particularly fast opening.

In a preferred refinement, a position sensor is arranged on a piston or on a piston rod of the control cylinder.

During normal operation, the control cylinder is actuated, independently of the 2/2 directional cartridge valves, by means of a directional control valve with proportional or on/off control. Furthermore, as a safety valve, there is provided a seat valve (blocking valve) by means of which the control cylinder and thus the fitting can be held in a predefined position without oil leakage. To move the fitting to a new position, the directional control valve and the blocking valve are activated and the control cylinder, provided with a supply via a pressure port and a tank port, is moved. During a test of the 2/2 directional cartridge valves, it is now possible in particular for the blocking valve, or else the directional control valve, that is to say the actual activation valves, to be switched into a deenergized state. If the 2/2 directional cartridge valves are now actuated, in particular repeatedly actuated, this leads, owing to the consumption of control oil, to an oil loss in the pressurized cylinder chamber and thus to a reduction of the compressions exerted on the control cylinder and ultimately to a change in the position of the fitting, if it is ensured that the control oil is extracted from the cylinder chamber. Even small changes are detected by the position sensor on the control cylinder. The process is detected by means of said detection of a position change and the feedback thereof to an electronic controller. The change at the fitting spindle is the clear indication that the fitting and also the entire oil path are functioning correctly. Since the mechanical dimensions and functions of all of the elements (valves, limit switches, sensors for the fitting position, initiated stroke, latency times) are taken into consideration in the check, said system checks not only the functionality itself, but rather also identifies changes which could gradually arise over a longer period of time (condition monitoring). By monitoring the proportional valve or the directional control valve with on/off control and the blocking element, the actual working elements are also incorporated in the check.

When the check is complete, the activation path for the proportional valve or the directional control valve with on/off control is transferred back to the superordinate controller. The check of the fitting function and of all of the elements and signals involved therein is fully documented and archived.

A real movement at the control cylinder under some circumstances amounts to only a fraction of the total possible working stroke. Here, a change of the fitting spindle does not trigger a real movement at the valve seat of the fitting if the movement takes place within the Hooke's line of the prestressed fitting spindle.

If a plurality of safety blocks are arranged in parallel with one another, then during a check of one safety block, the other safety blocks remain functional in order to ensure safety.

A first variant of the safety circuit according to the disclosure has a control cylinder by means of which, in an emergency (but if appropriate not only in an emergency) a main valve can be hydraulically or pneumatically relieved of pressure, wherein—in particular for which purpose—the control cylinder has a first cylinder chamber and a second cylinder chamber which can be connected to one another via a working line. In the working line there are provided a first and a second shut-off valve connected in series. The control cylinder may be for example a differential or synchronous cylinder.

A second variant of the safety circuit according to the disclosure has a control cylinder by means of which, in an emergency (but if appropriate not only in an emergency) a main valve can be hydraulically or pneumatically actuated, wherein the control cylinder has a first cylinder chamber which can be supplied with pressure medium via a first pressure medium flow path—in particular via a first working line. In the first pressure medium flow path—in particular in the first working line—there are provided a first and a second shut-off valve connected in series. The control cylinder may be for example a differential or synchronous cylinder with two cylinder chambers.

In both variants of the safety circuit according to the disclosure, one of the two shut-off valves can be tested while the other shut-off valve remains closed. Here, neither the valve nor the system needs to be placed out of operation.

A method for switching a safety circuit according to the disclosure according to one of the two variants in an emergency has the steps:

opening the first shut-off valve and the second shut-off valve;

opening the main valve.

In a preferred refinement of the second variant, the control cylinder has a second cylinder chamber which can be relieved of pressure via a second working line. Here, a first and a second shut-off valve connected in series are provided in the second working line.

In another preferred refinement of the second variant, the control cylinder has a second cylinder chamber which can be correspondingly supplied with pressure medium via a second pressure medium flow path. Here, the first and the second cylinder chamber can be alternatively relieved of pressure—in particular to a tank—via the respective pressure medium flow path. A first and a second shut-off valve connected in series are also provided in the second pressure medium flow path. This provides the possibility of selecting the adjustment direction of the control cylinder and thus of the valve in an emergency.

A method for switching said embodiment in an emergency has the steps:

opening the respective first shut-off valve and the respective second shut-off valve of the two working lines; and opening the main valve.

Here, there may be provided a total of six shut-off valves, of which two are working shut-off valves which are connected directly to the two cylinder chambers, two are P shut-off valves which are both connected directly to a pressure port of the safety circuit, and two are T shut-off valves which are both connected directly to a tank port of the safety circuit.

A method for switching said embodiment in an emergency has the steps:

opening the two working shut-off valves and one of the two P shut-off valves and one of the two T shut-off valves; and opening the main valve.

It is preferable for the shut-off valve connected in series to be formed in each case by logic valves or by 2/2 directional seat valves which have a valve body, the valve body having a closing surface which is active in a closing direction and an annular surface which is active in an opening direction. Here, the closing surface and the annular surface can both alternatively be relieved of pressure—in particular to the tank—or acted on with pressure medium.

It is furthermore preferable for the logic valves or the 2/2 directional seat valves to be pilot-controlled in each case by a 4/2 directional valve—in particular of seat-type design.

The switching into a deenergized state during emergency operation of the safety circuit, that is to say the opening of the main valve, may take place if the 4/2 directional valve has a valve body in whose spring-preloaded emergency position the closing surface which is active in a closing direction is relieved of pressure—in particular to the tank—whereas the annular surface which is active in an opening direction is acted on with pressure medium.

It is preferable for the shut-off valves connected in series and/or the pilot-control 4/2 directional valves to be electronically monitored—in particular by means of sensors fastened to the valve bodies.

In a particularly preferred application of the safety circuit according to the disclosure, the main valve is a shut-off valve or a safety valve of a system subjected to steam pressure.

The method according to the disclosure for the maintenance or servicing of a safety circuit of said type has the steps:

opening the first shut-off valve when the second shut-off valve is closed;

opening the second shut-off valve when the first shut-off valve is closed.

It is thus possible for any shut-off valve to be kept operable without the control cylinder and thus the main valve having to be adjusted, that is to say opened, for this purpose.

BRIEF DESCRIPTION OF THE DRAWINGS

Various exemplary embodiments of the disclosure will be described in detail below on the basis of the figures, in which.

DETAILED DESCRIPTION

Figure 1:
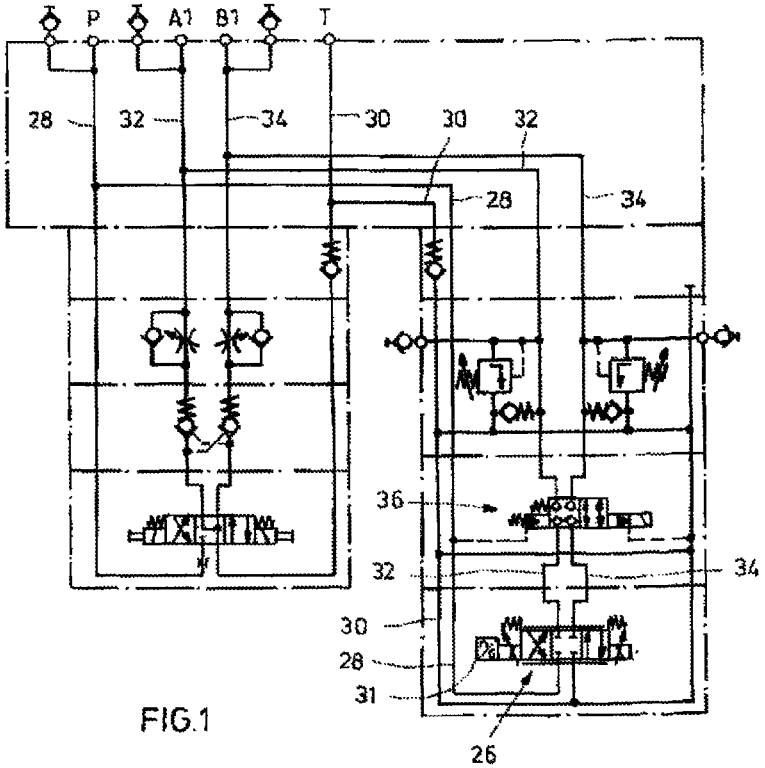
FIG. 1 shows a circuit diagram of a valve arrangement of a hydraulic drive for a fitting which has a regulating or switching valve, wherein the safety circuits shown in the following figures are connected to this circuit diagram.

FIG. 1 shows a circuit diagram of a valve arrangement of a hydraulic drive, to the ports, denoted by A1 and B1, of which are directly connected to in each case one working chamber 4; 204 or 6; 206 of a double-acting control cylinder 2; 202 (that shown in FIGS. 2 and 4 to 8). The control cylinders 2; 202 serve for adjusting a respective safety valve or regulating valve 1; 101; 401 of a fitting. Such a regulating valve 1; 101; 401 is for example a steam valve which, during normal operation, can assume intermediate positions in order to control the steam flow. The fitting may also be a switching valve which is closed or open during normal operation and which is intended to assume its second position in certain situations. Aside from steam, however, the control of the flow of another medium, which is transported or varied in terms of its parameters (for example by mixing) in the same way, is also conceivable.

For the adjustment of the regulating valve 1; 101; 401 during normal operation, the valve arrangement, shown in FIG. 1, of the hydraulic drive supplies to one of the ports A1, B1 a pressurized fluid (oil, air, gas or a gas mixture) which is available at a pump port P, while connecting the other of the two ports A1, B1 to a tank port T. The following components of the valve arrangement, shown in FIG. 1, of the hydraulic drive serve for this purpose: a proportionally (continuously) adjustable 4/3 directional valve 26 is arranged between the ports P and T at one side and the ports A1 and B1 at the other side, by means of which directional valve 26 the pressurization of the ports A1, B1 and thus the positioning of the regulating valve 1; 101; 401 is realized. Here, the proportional valve 26 is connected via a pump line 28 to the pump port P and via a tank line 30 to the tank port T. The position of a valve slide of the proportional valve 26 can be detected by means of a travel sensor 31.

An outlet of the proportional valve 26 is connected via a working line 32 to the port A1, whereas a second port of the proportional valve 26 is connected via a second working line 34 to the port B1.

In the two working lines 32, 34 there is arranged a seat valve 36 by means of which the two working lines 32, 34 can be shut off. The seat valve 36 serves, in the event of electrical failure or in the event of a safety check in any desired position of the regulating valve 1; 101; 401, to hold the control cylinder 2; 202 in a predefined position without oil leakage. To move to a new position, the proportional valve 26 which serves as a main direction valve and the seat valve 36 which serves as a safety blocking element are activated and the control cylinder 2; 202 are moved. Alternatively, the activation of the control cylinder may also be realized by means of a switching valve illustrated in FIG. 1.

Figure 2:
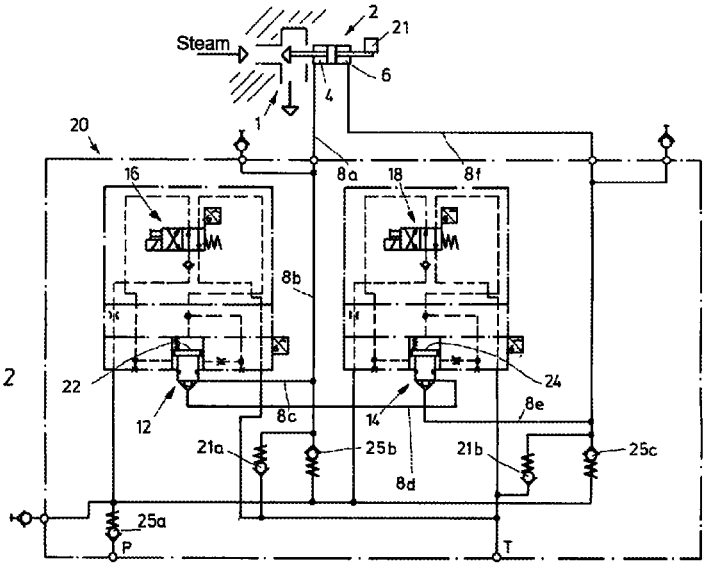
FIG. 2 shows a circuit diagram of a first exemplary embodiment of a safety circuit according to the disclosure.

FIG. 2 shows a circuit diagram of a first exemplary embodiment of a safety circuit according the disclosure. It has a safety valve or regulating valve 1 which, in an emergency, is available for releasing pressure from a system (not shown in any more detail) which is subjected to steam pressure. The safety valve or regulating valve 1 has a valve body which, during normal operation of the system, is held against a valve seat counter to the steam pressure and which, in an emergency, is raised into the position shown (in FIG. 2). The pressure of the steam has an assisting action here. For the actuation of the regulating valve 1, there is provided a synchronous cylinder 2 with the two cylinder chambers 4 and 6 which are of equal-sized free cross section, wherein the valve 1 is actuated in a closing direction by means of the supply of pressurized fluid into the cylinder chamber 6 with simultaneous displacement of pressurized fluid out of the cylinder chamber 4, and is actuated in an opening direction by means of the enabling of an outflow of pressurized fluid out of the cylinder chamber 6. Here, the pressure in the cylinder chamber 6 is defined by the pressure in the cylinder chamber 4 and the force exerted on the valve 1 in the opening direction thereof by the steam. By maintaining a pressure higher than said pressure in the cylinder chamber 6, the valve 1 can also be held closed. For fast complete opening of the valve 1, cylinder chambers 4, 6 of the synchronous cylinder 2 can be connected via a working line which is composed of the working line portions 8*a*, 8*b*, 8*c*, 8*d*, 8*e*, and 8*f*.

A position sensor 21 is arranged on a piston rod of the control cylinder 2.

A first logic valve 12 is provided between the two working line portions 8*c* and 8*d*, while a second logic valve 14 is provided between the two working line portions 8*d* and 8*e*. The two logic valves 12, 14, which according to the disclosure are connected in series, are 2/2 directional seat valves and are shown in FIG. 2 in a normal or basic position. Here, the two logic valves 12, 14 shut off the working line 8*a-f*, whereby the safety valve or regulating valve 1 can be controlled exclusively by means of the valve arrangement from FIG. 1. To switch over the two logic valves 12, 14 between normal operation and emergency operation, a first 4/2 directional valve 16 and a second 4/2 directional valve 18 serve for pilot control. The two logic valves 12, 14 and the two 4/2 directional valves 16, 18 are arranged together in and on a control plate 20 which has a pump port P and a tank port T.

The two 4/2 directional valves 16, 18 are shown in their basic or emergency position which is preloaded by a spring. In this way, a respective closing surface 22, 24, which is active in a closing direction, of the valve body or main control piston of the logic valves 12, 14 is connected via a relief line to the tank port T and is thus relieved of pressure. The relief of pressure may alternatively also take place, in particular if no tank port is provided or if a tank port is provided but not utilized and is closed by a plug, via a check valve 21*a* to the cylinder chamber 4 or via a check valve 21*b* to the cylinder chamber 6, depending on which cylinder chamber the lower pressure is prevailing in. In the exemplary embodiment of FIG. 2, this would be the cylinder chamber 4. The annular surfaces A4, which are active in each case in an opening direction, of the logic valves 12, 14 are acted on with pressure alternatively from a pump port P via a first check valve 23*a* or from the cylinder chamber 6 via a second check valve 23*b* or from the cylinder chamber 4 via a third check valve 23*c*. The valve bodies or main control pistons of the two logic valves 12, 14 are thus raised and the working line 8*a-f* is thus opened up. The two cylinder chambers 4, 6 of the synchronous cylinder 2 are thus connected, and the valve body of the safety valve or regulating valve 1 can be opened into the position shown in FIG. 2. In the other position of the pilot-control valves 16 and 18, the surfaces 22 are acted on with pressure and the surfaces A4 are relieved of pressure. In the figures, the logic valves together with their pilot control arrangement are shown in a rest position which they assume when no pressure is present in the system. The pilot-control valves 16 and 18 are thus—by contrast to the main stages—arranged in parallel with one another with regard to their pressure and tank ports and can thus activate their main stages independently of one another.

The 4/2 directional valves 16 and 18 may also be formed as 4/2 directional seat valves. It is then the case that the leakage oil flow via the pilot control arrangement is non-existent or very small. Such 4/2 directional seat valves are known for example from the data sheet RD 22058/07.09, page 5/14 from Bosch Rexroth AG.

As already indicated, in a variant of the exemplary embodiment according to FIG. 2, the tank port T may also be omitted or may be unutilized and plugged. It is likewise possible for the pressure port P together with the check valve 25*a* to be omitted, or plugged if no check valve is provided.

In the exemplary embodiment according to FIG. 2, the cylinder chamber 6 is in each case charged with pressure. The pressure in the cylinder chamber 4 is lower than that in the cylinder chamber 6. In principle, the check valves 25*b* and 25*c* and 21*a* and 21*b* would thus not be necessary. The respective pressure port of the two pilot-control valves 16 and 18 could be connected directly only to the cylinder chamber 6, and the respective relief port could be connected directly only to the cylinder chamber 4. This is also conceivable if, as shown in FIG. 2, the tank port T and the pressure port P with check valve 25*a* are provided. It would then be the case that the same pressure prevails in the cylinder chamber 4 as at the tank port T. The pressure at the pressure port P would normally be lower than in the cylinder chamber 6, such that the check valve 25*a* is closed. If, however, the check valves 21*a*, 21*b*, 25*b*, and 25*c*, are provided as shown in FIG. 2, then an arrangement of the control plate is also possible in which the working ports, which are connected to the cylinder chambers of the control cylinder 2, of the control plate 20 are reversed. The pressure port P and tank port T would self-evidently have to be correctly connected to the other components of the system. The reversibility increases the flexibility and entails increased assembly and functional reliability.

Figure 3:
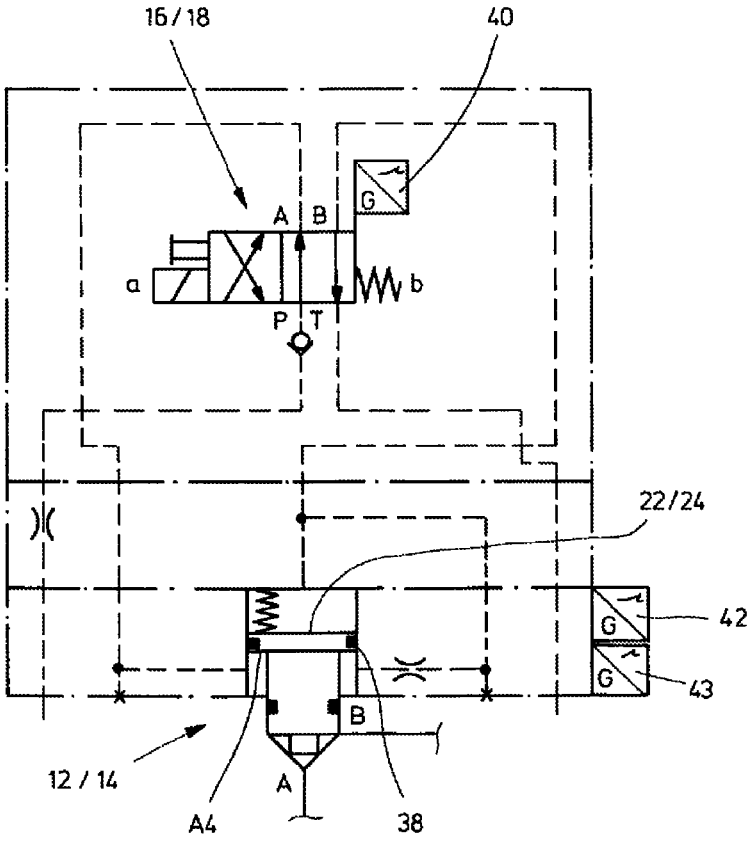
FIG. 3 shows an active logic valve with pilot-control valve according to the first and the further exemplary embodiments.

FIG. 3 shows the logic valve 12/14 with the pilot-control valve 16/18 according to FIG. 2 in an enlarged illustration and with additional details. Said arrangement is also installed in many of the following exemplary embodiments.

The logic valve 12/14 is an active logic valve 12/14, the main control piston of which has the annular surface or active surface A4, which is active in an opening direction and which can be acted on with pressure independently of the pressure at one of the ports A and B, and the closing surface 22/24 which is active in a closing direction. On a collar of the main control piston arranged in between, there is arranged a seal 38 for delimiting the two adjoining chambers, in which different pressures prevail both during normal operation and also during emergency operation, from one another.

The active surface A4 of the logic valve 12 is also advantageous for the initiation of emergency operation because the opening stroke of the logic valve 12 begins at the same time as the opening stroke of the logic valve 14, and not only after a small opening stroke of the logic valve 14 which leads to a pressure build-up in the line portion 8*d*.

The valve body of the pilot-control valve 16/18 and the main control piston of the active logic valve 12/14 are subjected to position monitoring by means of a respective limit switch 40 and 42. The limit switch 40 detects whether the valve body of a pilot-control valve has passed into its switched position. The limit switch 42 detects whether the piston of the main stage of a logic valve has passed into its open end position. It is also possible for in each case one second limit switch to be provided in order to detect both end positions in each case. FIG. 3 shows a second limit switch 43 by means of which the closed position of the main stage of the logic valve is monitored. For the piston of the main stage, continuous travel detection may also be provided, such that different open end positions can be detected without mechanical adjustment of a limit switch.

Figure 4:
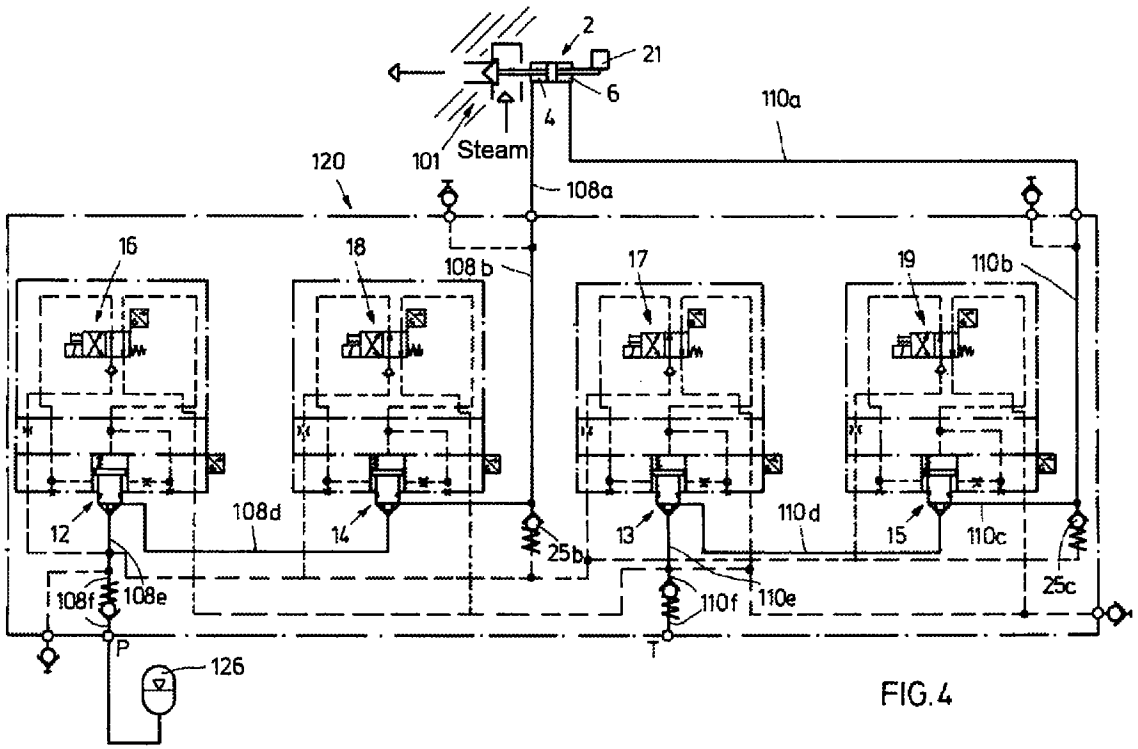
FIG. 4 shows a circuit diagram of a second exemplary embodiment of the safety circuit according to the disclosure.

FIG. 4 shows a circuit diagram of a second exemplary embodiment of a safety circuit according to the disclosure. By means of the synchronous cylinder 2, during normal operation, a valve body of a safety valve or regulating valve 101 is held closed, wherein in this exemplary embodiment, the steam pressure of the system (not shown in any more detail) has an assisting action in a closing direction. The flow direction of the steam through the setting is thus reversed in relation to the exemplary embodiment according to FIG. 2.

The first cylinder chamber 4 of the synchronous cylinder 2 can be connected via a first working line to the pressure port P of a control plate 120. Here, the first working line is divided into the sections 108*a*, 108*b*, 108*c*, 108*d*, 108*e*, and 108*f*. A first logic valve 12 is arranged between the two portions 108*e* and 108*d*, whereas a second logic valve 14 is arranged between the two portions 108*d* and 108*c*.

The second cylinder chamber 6 of the synchronous cylinder 2 is connected via a second working line to the tank port T of the control plate 120. Here, the second working line is divided into the portions 110*a*, 110*b*, 110*c*, 110*d*, 110*e*, and 110*f*. A third logic valve 15 is arranged between the two portions 110*c* and 110*d*, whereas a fourth logic valve 13 is arranged between the two portions 110*d* and 110*e*. All of the logic valves are active logic valves with an annular surface, denoted in FIG. 3 by A4, on the piston, which annular surface acts in an opening direction when subjected to pressure.

The logic valve 12 is pilot-controlled by a 4/2 directional valve 16, the logic valve 14 is pilot-controlled by a 4/2 directional valve 18, the logic valve 15 is pilot-controlled by a 4/2 directional valve 19, and the logic valve 13 is pilot-controlled by a 4/2 directional valve 17. The logic valves 12, 13, 14 and 15 and the 4/2 directional valve 16, 17, 18 and 19 are identical in construction to, and function in the same way as, the logic valves and pilot-control valves provided in the first exemplary embodiment according to FIG. 2.

The logic valves 12 to 15 are shown in their closed position, wherein one must imagine that the electromagnets of the pilot-control valves 16 to 19 are energized and the pilot-control valves, by contrast to that shown in FIG. 4, assume their switched position in which the surfaces 22/24 (see FIG. 3) are acted on with pressure and the surfaces A4 (see FIG. 3) are relieved of pressure. The fitting 101 assumes the closed normal position shown in FIG. 4. During emergency operation of the safety circuit, the four 4/2 directional valves 16 to 19 are, after the deactivation of the electromagnets, switched by a respective spring into their basic or emergency position shown in FIG. 4, whereby the valve bodies of the logic valves are raised from their valve seats. In this way, the first working line 108*a-f* and the second working line 110*a-f* are opened up. It is thus possible for a reserve amount of pressure medium to flow from the pressure accumulator 126, which is kept at a certain pressure, via the pressure port P and via the first working line 108*a-f* into the first cylinder chamber 4, while a corresponding amount of pressure medium flows out of the second cylinder chamber 6 by the second working line 110*a-f* and via the tank port T to a tank (not shown). The piston and the piston rod of the control cylinder 2 are moved in the direction for an increase in size of the cylinder chamber 4 and a decrease in size of the cylinder chamber 6, and raise the valve body of the safety valve or regulating valve 101 from its valve seat. Steam can escape from the steam-conducting system (not shown) as indicated by the two arrows.

The first working line 108*a-f* thus serves, during emergency operation, as a supply line, whereas the second working line 110*a-f* serves as a return line. During emergency operation, a supply can be provided to the first cylinder chamber 4 via the first working line 108*a-f* from the pressure accumulator 126 which, during normal operation of the safety circuit, is charged to a certain pressure.

It is also conceivable that, during normal operation, the fitting 101 from FIG. 4 is situated in an open position which can be adjusted by means of a controller according to FIG. 1. During emergency operation, the fitting must then be fully opened quickly. This is realized by means of the logic valves 12 to 15. Here, the fast movement of the fitting into the position provided for emergency operation is ensured even if the proportional valve 26 or the switching valve from FIG. 1 receives a signal which opposes the movement of the fitting into the emergency position. This is because the throughflow cross sections of the logic valves are so large in relation to the throughflow cross sections in the valve 25 that the logic valves override the valve 26.

Figure 5:
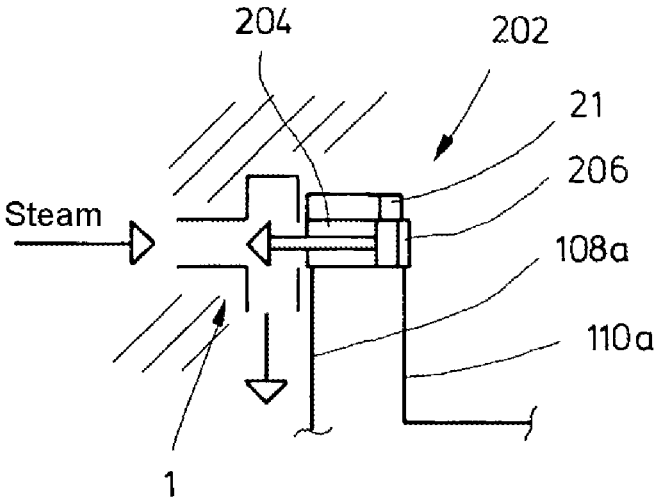
FIG. 5 shows a safety valve or regulating valve, with differential cylinder, of a third exemplary embodiment of the safety circuit according to the disclosure.

FIG. 5 shows a detail of a third exemplary embodiment of the safety circuit according to the disclosure. Here, the safety valve or regulating valve 1 is shown, as in the first exemplary embodiment (compare FIG. 2), as being actuated in a closing direction counter to the steam pressure and being opened with steam assistance during emergency operation.

A differential cylinder 202, whose first cylinder chamber 204 is a piston-rod-side cylinder chamber while a second cylinder chamber 206 is a base-side cylinder chamber, serves for this purpose.

The piston of the differential cylinder 202 is operatively connected to a position sensor 21 which detects any position of the piston.

The third exemplary embodiment of the safety circuit according to the disclosure otherwise corresponds, with regard to the lines, the control plate with the valves and the pressure accumulator, to the second exemplary embodiment according to FIG. 4. Accordingly, the first cylinder chamber 204 is connected via the first working line 108*a-f* to the pressure port P of the control plate 120, whereas the second cylinder chamber 206 is connected via the second working line 110*a-f* to the tank port T of the control plate 120. Of said two working lines, in each case only a part of the first portion 108*a* and 110*a* respectively is shown.

Figure 6:
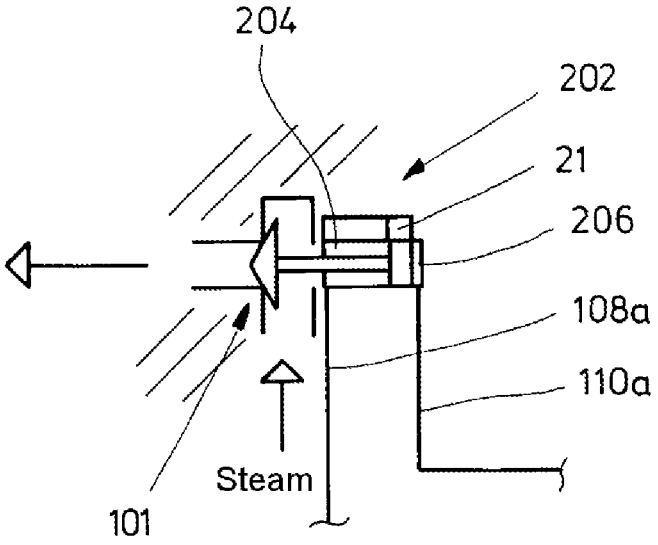
FIG. 6 shows a safety valve or regulating valve, with differential cylinder, of a fourth exemplary embodiment of the safety circuit according to the disclosure.

FIG. 6 shows the safety valve or regulating valve 101 with a throughflow as per the second exemplary embodiment (compare FIG. 4), wherein the differential cylinder 202 as per the third exemplary embodiment (compare FIG. 5) is used for the adjustment of said valve.

The fourth exemplary embodiment of the safety circuit according to the disclosure n otherwise corresponds, with regard to the lines, the control plate with the valves and the pressure accumulator, to the second exemplary embodiment according to FIG. 4. Accordingly, the first cylinder chamber 204 is connected via the first working line 108*a-f* to the pressure port P of the control plate 120, whereas the second cylinder chamber 206 is connected via the second working line 110*a-f* to the tank port T of the control plate 120. Of said two working lines, in each case only a part of the first portion 108*a* and 110*a* respectively is shown.

According to FIG. 6, the safety valve or regulating valve 1 is, as in the second exemplary embodiment (compare FIG. 4,) traversed by flow of steam such that it is actuated in an opening direction counter to the steam pressure and is closed with steam assistance during emergency operation.

During emergency operation, pressure medium is supplied—for example from the pressure accumulator 126—to the first cylinder chamber 204 by the first working line 108*a-f*. The safety valve or regulating valve 101 thus opens counter to the steam pressure. Pressure medium is displaced out of the second cylinder chamber 206.

Figure 7:
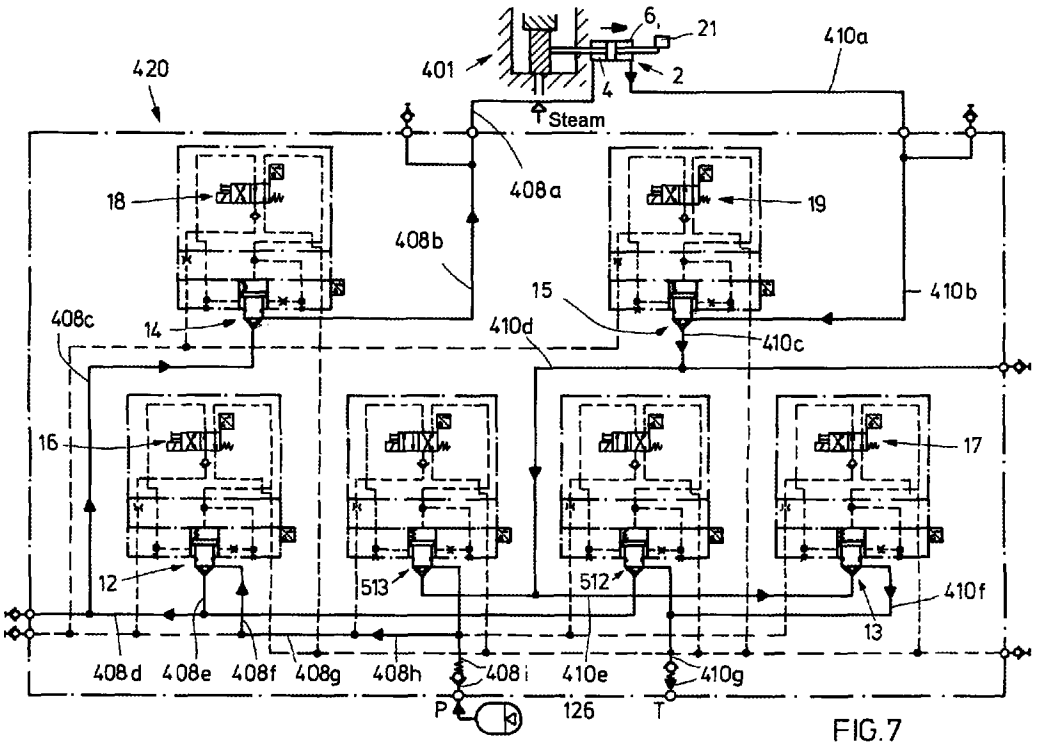
FIG. 7 shows a circuit diagram of a fifth exemplary embodiment of the safety circuit according to the disclosure.

FIG. 7 shows a circuit diagram of a fifth exemplary embodiment of the safety circuit according to the disclosure. A valve body of a safety valve or regulating valve 401 is shown, as per normal operation, in its basic position in which it shuts off steam of a system (not shown in any more detail). Proceeding from the position shown, the valve body can be displaced to the right—as viewed in FIG. 7—as per the arrow above the synchronous cylinder during emergency operation by means of the synchronous cylinder 2, by pressurization of a first cylinder chamber 4. A first working line of a control plate 420 serves for this purpose, which working line can connect a pressure port P to the first cylinder chamber 4 via two logic valves 12, 14 which, according to the disclosure, are connected in series. The pressure medium displaced out of the second cylinder chamber 6 in the process flows via a second working line to a tank port T of the control plate 420, wherein in the second working line, too, there are arranged two logic valves 15, 13 which, according to the disclosure, are connected in series. Here, the first working line is composed of the line portions 408*a*, 408*b*, 408*c*, 408*d*, 408*e*, 408*f*, 408*g*, 408*h* and 408*i*. The second working line is composed of the line portions 410*a*, 410*b*, 410*c*, 410*d*, 410*e*, 410*f* and 410*g*. The first logic valve 12 is arranged in the first working line between the line portions 408*e* and 408*f*, while the second logic valve 14 is arranged between the line portions 408*b* and 408*c*. The first logic valve 13 is arranged in the second working line between the line portions 410*e* and 410*f*, while the second logic valve 15 is arranged between the line portions 410*b* and 410*c*. Furthermore, the control plate 420 has two further logic valves 512, 513, which are not required in the fifth exemplary embodiment according to FIG. 7. All of the logic valves are active logic valves.

The two first logic valves 12, 13 and the two second logic valves 14, 15 and the two logic valves 512, 513 not required in the fifth exemplary embodiment are pilot-controlled in the manner known from the exemplary embodiments 1 and 2.

Figure 8:
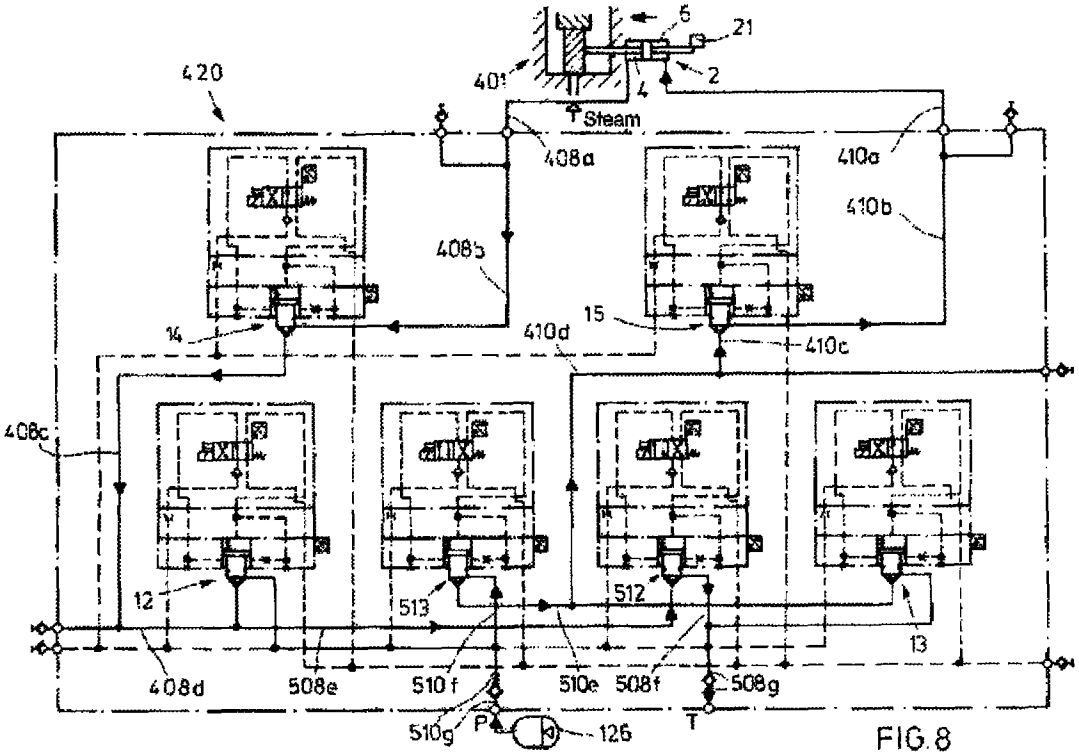
FIG. 8 shows a circuit diagram of a sixth exemplary embodiment of the safety circuit according to the disclosure.

FIG. 8 shows a circuit diagram of a sixth exemplary embodiment of the safety circuit according to the disclosure. With regard to the components, that is to say lines and valves, use is made of the arrangement from the fifth exemplary embodiment according to FIG. 7. With regard to functioning, it is the intention in this exemplary embodiment of the valve body of the safety valve or regulating valve 401 for adjustment to take place during emergency operation from the normal position shown in FIG. 8 not from left to right as in the exemplary embodiment according to FIG. 7, but rather from right to left as per the arrow above the synchronous cylinder 2. For this purpose, the second cylinder chamber 6 of the synchronous cylinder 2 is connected via a second working line—modified in relation to the fifth exemplary embodiment—to the pressure port P of the control plate 420, while the first cylinder chamber 4 of the synchronous cylinder 2 is relieved of pressure by a first working line—modified in relation to the fifth exemplary embodiment—to the tank port T. The line portions 408*a*, 408*b*, 408*c*, 408*d*, 508*e*, 508*f*, 508*g* now serve as the first working line, while the line portions 410*a*, 410*b*, 410*c*, 410*d*, 510*e*, 510*f*, 510*g* serve as the second working line.

According to the disclosure, two logic valves 512, 14 connected in series with one another are arranged in the first working line. Here, the first logic valve 512 is arranged between the line portions 508*e* and 508*f*, while the second logic valve 14 is arranged between the line portions 408*b* and 408*c*. In the second working line, the first logic valve 513 is arranged between the line portions 510*e* and 510*f*, while the second logic valve 15, which according to the disclosure is connected in series with said first logic valve 513, is arranged between the line portions 410*b* and 410*c*.

The two logic valves, which in the fifth exemplary embodiment according to FIG. 7 are used as the two first logic valves 12, 13, are not used or utilized in the sixth exemplary embodiment according to FIG. 8.

It is thus the case that the control plate 420 according to the fifth and the sixth exemplary embodiment with the total of six pilot-controlled logic valves 12, 13, 14, 15, 512, 513 serves for the normal operation and the emergency operation of the safety valve or regulating valve 401, both when the latter is to be adjusted, during emergency operation, in one direction from the central position according to the fifth exemplary embodiment, and also when said valve 401 is supposed to be adjusted in the opposite direction according to the sixth exemplary embodiment. Depending on the desired movement direction, it is self-evidently necessary, in order that no short-circuit occurs between the pressure port P and the tank port T of the control plate 420, that in an emergency situation one of the two valves 12 and 512 or 13 and 513 remains closed until the valve body of the fitting 401 has permitted a steam flow.

The two logic valves 12 and 512 thus correspondingly differ, like the two logic valves 13 and 513, with regard to their pilot control. During normal operation, the pilot-control valves of the logic valves 12, 13, 14 and 15 are energized, and the logic valves 12 to 15 are then closed. When the pilot-control valves are deenergized, the logic valves 12 to 15 are open. If identical pilot-control valves are now used for the logic valves 512 and 513, said pilot-control valves must remain energized in an emergency situation in the case of the mode of operation according to FIG. 7, whereas the pilot-control valves of the logic valves 12 and 13 must remain energized in an emergency situation in the case of a mode of operation according to FIG. 8. If, in the case of the pilot-control valves of the logic valves 512 and 513, the rest position and the switched position are reversed in relation to the pilot-control valves 16 and 17, as is shown in FIGS. 7 and 8, then during normal operation, the pilot-control valves of the logic valves 512 and 513 are not energized. It is then the case in an emergency situation that, in the case of a mode of operation according to FIG. 7, the pilot-control valve of the logic valves 512 and 513 should be left deenergized, and in the case of the mode of operation according to FIG. 8, the pilot-control valves of the logic valves 512 and 513 should be energized and the pilot-control valves of the logic valves 12 and 13 should be left deenergized.

In all of the exemplary embodiments shown, it is possible for testing purposes, or in order to keep the valve body or the main control piston of the logic valves 12, 13, 14, 15, 512, 513 operable, for one of two logic valves 12, 13, 14, 15, 512, 513 connected in series to be opened while the other logic valve 12, 13, 14, 15, 512, 513 remains closed. Here, the system with the safety valve or regulating valve 1; 101; 401 remains in normal operation for as long as the safety of the safety circuit and of the system (not shown) continues to exist. Here, at least those logic valves at whose working ports no pressure from one of the cylinder chambers or from a pressure port P of the control plate prevails during normal operation are formed as active logic valves with a surface which acts in an opening direction and which can be acted on with pressure independently of the working ports. It is advantageous for all of the logic valves to be active logic valves.

In a manner supplementary to the exemplary embodiments shown, it is possible for a plurality of control plates 20; 120; 420 for identical or different threshold values to be provided on and connected to the cylinder 2; 202.

By contrast to the exemplary embodiments shown, the safety circuits according to the invention disclosure may also serve to hold the safety valve or regulating valve 1; 101; 401 open during normal operation and close said valve during emergency operation.

For the main stage of a logic valve, there are two combination possibilities with limit switches. A distinction can basically be made between a closed signaled position and an open signaled position. The closed position is always clearly defined in terms of its location. An open position is clearly defined only for 100% opening travel. Both positions may be interrogated digitally by electric openers or closers or an opener/closer combination.

An open position may, by means of a stroke limiter for the valve piston of the main stage, be situated somewhere at an intermediate position between the closed position and the 100% open position. Said intermediate position corresponds to a measurement value of greater than zero and less than 100% as a voltage or current of an analog position sensor which may be used, without mechanical adjustment, to also detect the intermediate positions.

For the testing of the logic valves 12, 13, 14, 15, 512, 513 of all of the exemplary embodiments, there are, according to the disclosure, two methods available: in a first method, in each case only one of the two logic valves 12, 13, 14, 15, 512, 513 within a line is opened. Said opening stroke of the main control piston is identified by the associated limit switch 42. Here, the other logic valve 12, 13, 14, 15, 512, 513 connected in series in each case remains closed. Any control oil extracted from a cylinder chamber 4 or 6 is replaced by readjustment by means of the proportional valve 26 from FIG. 1.

In a second method, firstly, that part of the drive which is shown in FIG. 1 is switched into an inactive state. For this purpose, the proportional valve 26 and in particular the seat valve 36 are switched into a deenergized state (compare the positions illustrated in FIG. 1). A programmable logic controller (not shown) will thereupon open one of two logic valves, which are arranged in series with one another, by changing the energization of the electromagnet of the associated 4/2 directional valve 16. Said logic valve is subsequently closed again and the logic valve connected in series therewith is opened by means of the associated 4/2 directional valve 18. Here, the correct or incorrect functioning of the logic valves can be identified by means of the position or location sensor assigned to the main stages of the logic valve.

The alternate switching of two logic valves connected in series with one another is if appropriate performed numerous times in succession. A certain amount of control oil is consumed during every switching process. At least in the exemplary embodiments according to FIGS. 2 and 4, said control oil is extracted from a cylinder chamber of the control cylinder 2 if the pressure therein is higher than the pressure at the pressure port P of the control plate. In the exemplary embodiment of FIG. 2, an in each case small oil loss in the pressurized cylinder chamber 4 of the control cylinder 2 has the effect that the valve body of the regulating valve 1 either is relieved of pressure but not opened or departs slightly from its position.

Said process is detected by means of the position sensor 21 on the control cylinder 2; 202 and the programmable logic controller. This serves as evidence that both the entire oil path and also the control cylinder 2; 202 and thus the regulating valve 1; 101 are functioning.

Since, with said method and said check, the mechanical dimensions and functions of all of the elements (valves, limit switches, position sensors, initiated stroke, latency times) are taken into consideration, said system checks not only the functionality itself, but rather also identifies changes which could gradually arise over a longer period of time (condition monitoring). By monitoring the proportional valve 26 and the blocking element or seat valve 36, the actual drive elements of the hydraulic drive according to the disclosure are also incorporated in the check. For this purpose, the hydraulic drive according to the disclosure is formed as a balanced and closed system.

When the check (according to one of the described variants) is complete, the activation path for the proportional valve 26 is transferred back to the programmable logic controller. That part of the hydraulic drive which is shown in FIG. 1 thus takes over again the task of subjecting the control cylinder 2; 202 to pressure medium via its ports A1 and B1 directly connected to the cylinder chambers 4; 204 and 6; 206. It is optionally also possible for the regulating deviations of the proportional valve 26 to be evaluated and compared with the position monitoring of the fitting, such that the regulation function is also monitored.

Two variants of a safety circuit for valves hydraulically or pneumatically actuated by means of a control cylinder are disclosed.

In the first variant, the control cylinder can be hydraulically or pneumatically relieved of pressure in an emergency. For this purpose, the control cylinder has two cylinder chambers which can be fluidically connected via a working line. A first and a second shut-off valve connected in series are provided in the working line.

1. Safety circuit having a control cylinder 2, by means of which a main valve 1 can be hydraulically or pneumatically relieved of pressure in an emergency, wherein the control cylinder 2 has a first and a second cylinder chamber 4, 6 which can be connected via a working line 8*a-f*, characterized in that a first and a second shut-off valve 12, 14 connected in series are provided in the working line 8.

According to the second variant, the control cylinder can be hydraulically or pneumatically actuated in an emergency. For this purpose, the control cylinder has at least one first cylinder chamber which, in an emergency, can be supplied with pressurized fluid via a first pressure medium flow path. A first and a second shut-off valve connected in series are provided in the first working line.

2. Safety circuit having a control cylinder 2; 202, by means of which a main valve 1; 101; 401 can be hydraulically or pneumatically actuated in an emergency, wherein the control cylinder 2; 202 has a first cylinder chamber 4; 204 which can be supplied with pressure medium via a first pressure medium flow path 108; 408; 508, characterized in that a first and a second shut-off valve 12, 14 connected in series are provided in the first pressure medium flow path 108; 408; 508.

The following are aspects of the disclosure:

3. Safety circuit according to variant 2, wherein the control cylinder 2; 202 has a second cylinder chamber 6; 206 which can be relieved of pressure via a second working line 110*a-f*, and wherein a first and a second shut-off valve 12, 14 connected in series are provided in the second working line 110.
4. Safety circuit according to variant 2, wherein the control cylinder has a second cylinder chamber 6 which can be supplied with pressure medium via a second pressure medium flow path, and wherein the first and the second cylinder chamber 4, 6 can be relieved of pressure via the respective pressure medium flow path, and wherein a first and a second shut-off valve 12, 14 connected in series are provided in the second pressure medium flow path.
5. Safety circuit according to aspect 4, wherein six shut-off valves 12, 14 are provided.
6. Safety circuit according to variant 1 or 2, wherein the shut-off valves are formed by logic valves 12, 14 or by 2/2 directional seat valves which have in each case one valve body which has a closing surface 22, 24 which acts in a closing direction and an annular surface which acts in an opening direction, wherein the closing surface 22, 24 and the annular surface can be in each case relieved of pressure or acted on with pressure medium.
7. Safety circuit according to aspect 6, wherein the logic valves 12, 14 or the 2/2 directional seat valves are pilot-controlled in each case by a 4/2 directional valve 16, 18.
8. Safety circuit according to aspect 7, wherein the 4/2 directional valve 16, 18 has a valve body, in whose spring-preloaded emergency position the closing surface 22, 24 is relieved of pressure while the annular surface is acted on with pressure medium.
9. Safety circuit according to aspect 7, wherein the shut-off valves 12, 14 and/or the 4/2 directional valves 16, 18 are electronically monitored.
10. Safety circuit according to variant 1, wherein the main valve is a shut-off valve or a safety valve 1; 101; 401 of a system subjected to steam pressure.

The invention claimed is:

1. A hydraulic or pneumatic drive, comprising:

a control cylinder having a first cylinder chamber connected to a first hydraulic or pneumatic line; and a first safety circuit having two shut-off valves connected in series with one another and arranged in the first line, wherein the two shut-off valves are a first 2/2 directional cartridge valve and a second 2/2 directional cartridge valve fluidically arranged closer to the first cylinder chamber than the first 2/2 directional cartridge valve such that (i) the first cylinder chamber is connected to a first working port of the second 2/2 directional cartridge valve, (ii) the first working port is connected to a second working port of the second 2/2 directional cartridge valve when the second 2/2 directional cartridge valve is open, (iii) the second working port is connected only to a third working port of the first 2/2 directional cartridge valve, and (iv) the third working port is connected to a fourth working port of the first 2/2 directional control valve when the first 2/2 directional cartridge valve is open, wherein the first and second 2/2 directional cartridge valves each (i) have one main control piston configured to control a fluidic connection between two respective working ports and (ii) include one pilot-control valve, wherein at least the first 2/2 directional cartridge valve has a surface which is active in an opening direction and which is configured to be subjected to a pressure by the associated pilot-control valve independently of the working ports, and wherein the control cylinder is a synchronous cylinder that includes the first cylinder chamber and a second cylinder chamber, and wherein the first line runs between the two cylinder chambers.

2. The hydraulic or pneumatic drive as claimed in claim 1, wherein the pilot-control valves of the first and second 2/2 directional cartridge valves are arranged such that their ports, which are connected to a pressure medium source and to a pressure medium sink, are in parallel with one another.

3. The hydraulic or pneumatic drive as claimed in claim 1, wherein the main control piston of the actively controllable 2/2 directional cartridge valves have seals configured to seal off a control chamber which acts in a closing direction with respect to the control chamber which acts, independently of the working ports, in an opening direction.

4. The hydraulic or pneumatic drive as claimed in claim 1, wherein the pilot-control valves are 4/2 directional seat valves.

5. The hydraulic or pneumatic drive as claimed in claim 1, wherein all of the 2/2 directional cartridge valves have a surface which is active in an opening direction and which is configured to be subjected to a pressure by the associated pilot-control valve independently of the working ports.

6. A hydraulic or pneumatic drive, comprising:

a control cylinder having a first cylinder chamber connected to a first hydraulic or pneumatic line; and a first safety circuit having two shut-off valves connected in series with one another and arranged in the first line, wherein the two shut-off valves are a first 2/2 directional cartridge valve and a second 2/2 directional cartridge valve fluidically arranged closer to the first cylinder chamber than the first 2/2 directional cartridge valve such that (i) the first cylinder chamber is connected to a first working port of the second 2/2 directional cartridge valve, (ii) the first working port is connected to a second working port of the second 2/2 directional cartridge valve when the second 2/2 directional cartridge valve is open, (iii) the second working port is connected only to a third working port of the first 2/2 directional cartridge valve, and (iv) the third working port is connected to a fourth working port of the first 2/2 directional control valve when the first 2/2 directional cartridge valve is open, wherein the first and second 2/2 directional cartridge valves each (i) have one main control piston configured to control a fluidic connection between two respective working ports and (ii) include one pilot-control valve, wherein at least the first 2/2 directional cartridge valve has a surface which is active in an opening direction and which is configured to be subjected to a pressure by the associated pilot-control valve independently of the working ports, wherein the control cylinder is of double-acting design and has (i) the first cylinder chamber connected to the first line and the first safety circuit with the first and second 2/2 directional cartridge valves, and (ii) a second cylinder chamber connected to a second hydraulic or pneumatic line, wherein the hydraulic or pneumatic drive further includes a second safety circuit having a third 2/2 directional cartridge valve and a fourth 2/2 directional cartridge valve connected in series with the third 2/2 directional cartridge valve, the fourth 2/2 directional cartridge valve being fluidically arranged closer to the second cylinder than the third 2/2 directional cartridge valve, said third and fourth 2/2 directional cartridge valves (i) both being arranged in the second line, (ii) each having one main control piston configured to control a fluidic connection between two respective working ports, and (iii) each comprising one pilot-control valve, and wherein at least the third 2/2 directional cartridge valve has a surface which is active in an opening direction and which is configured to be subjected to a pressure by the associated pilot-control valve independently of the working ports.

7. The hydraulic or pneumatic drive as claimed in claim 6, wherein the third 2/2 directional cartridge valve and the fourth 2/2 directional cartridge valve each have one surface which is active in an opening direction and which is configured to be subjected to a pressure by the associated pilot-control valve independently of the working ports.

8. The hydraulic or pneumatic drive as claimed in claim 6, wherein the pilot-control valves of the first and second 2/2 directional cartridge valves are arranged such that their ports, which are connected to a pressure medium source and to a pressure medium sink, are in parallel with one another.

9. The hydraulic or pneumatic drive as claimed in claim 6, wherein the main control piston of the actively controllable 2/2 directional cartridge valves have seals configured to seal off a control chamber which acts in a closing direction with respect to the control chamber which acts, independently of the working ports, in an opening direction.

10. The hydraulic or pneumatic drive as claimed in claim 6, wherein the pilot-control valves are 4/2 directional seat valves.

11. The hydraulic or pneumatic drive as claimed in claim 6, wherein all of the 2/2 directional cartridge valves have a surface which is active in an opening direction and which is configured to be subjected to a pressure by the associated pilot-control valve independently of the working ports.

12. A hydraulic or pneumatic drive, comprising:

a control cylinder having a first cylinder chamber connected to a first hydraulic or pneumatic line; and a first safety circuit having two shut-off valves connected in series with one another and arranged in the first line, wherein the two shut-off valves are a first 2/2 directional cartridge valve and a second 2/2 directional cartridge valve fluidically arranged closer to the first cylinder chamber than the first 2/2 directional cartridge valve such that (i) the cylinder chamber is connected to a first working port of the second 2/2 directional cartridge valve, (ii) the first working port is connected to a second working port of the second 2/2 directional cartridge valve when the second 2/2 directional cartridge valve is open, (iii) the second working port is connected only to a third working port of the first 2/2 directional cartridge valve, and (iv) the third working port is connected to a fourth working port of the first 2/2 directional control valve when the first 2/2 directional cartridge valve is open, wherein the first and second 2/2 directional cartridge valves each (i) have one main control piston configured to control a fluidic connection between two respective working ports and (ii) include one pilot-control valve, wherein at least the first 2/2 directional cartridge valve has a surface which is active in an opening direction and which is configured to be subjected to a pressure by the associated pilot-control valve independently of the working ports, wherein the control cylinder is of double-acting design and has (i) the first cylinder chamber connected to the first line and the first safety circuit with the first and second 2/2 directional cartridge valves, and (ii) a second cylinder chamber connected to a second hydraulic or pneumatic line, wherein the hydraulic or pneumatic drive further includes a second safety circuit having a third 2/2 directional cartridge valve and a fourth 2/2 directional cartridge valve connected in series with the third 2/2 directional cartridge valve, the fourth 2/2 directional cartridge valve being fluidically arranged closer to the second cylinder than the third 2/2 directional cartridge valve, said third and fourth 2/2 directional cartridge valves (i) both being arranged in the second line, (ii) each having one main control piston configured to control a fluidic connection between two respective working ports, and (iii) each comprising one pilot-control valve, wherein at least the third 2/2 directional cartridge valve has a surface which is active in an opening direction and which is configured to be subjected to a pressure by the associated pilot-control valve independently of the working ports, wherein a first further 2/2 directional cartridge valve is connected with a fifth working port to the fluidic connection between the first 2/2 directional cartridge valve and the second 2/2 directional cartridge valve, wherein a second further 2/2 directional cartridge valve is connected with a sixth working port to the connection between the third 2/2 directional cartridge valve and the fourth 2/2 directional cartridge valve, and wherein the further 2/2 directional cartridge valves (i) each comprise one pilot-control valve and one main control piston configured to control the fluidic connection between two respective working ports and (ii) are connected with their second working port in each case to a different port of the respective safety circuit than the first and third 2/2 directional cartridge valves.

13. The hydraulic or pneumatic drive as claimed in claim 12, wherein the pilot-control valves of the first and second 2/2 directional cartridge valves are arranged such that their ports, which are connected to a pressure medium source and to a pressure medium sink, are in parallel with one another.

14. The hydraulic or pneumatic drive as claimed in claim 12, wherein the third 2/2 directional cartridge valve and the fourth 2/2 directional cartridge valve each have one surface which is active in an opening direction and which is configured to be subjected to a pressure by the associated pilot-control valve independently of the working ports.

15. The hydraulic or pneumatic drive as claimed in claim 12, wherein the main control piston of the actively controllable 2/2 directional cartridge valves have seals configured to seal off a control chamber which acts in a closing direction with respect to the control chamber which acts, independently of the working ports, in an opening direction.

16. The hydraulic or pneumatic drive as claimed in claim 12, wherein the pilot-control valves are 4/2 directional seat valves.

17. The hydraulic or pneumatic drive as claimed in claim 12, wherein all of the 2/2 directional cartridge valves have a surface which is active in an opening direction and which is configured to be subjected to a pressure by the associated pilot-control valve independently of the working ports.

* * * * *